US010714801B2

(12) United States Patent
Liu et al.

(10) Patent No.: US 10,714,801 B2
(45) Date of Patent: Jul. 14, 2020

(54) BAND-PASS FILTERING STRUCTURE AND ANTENNA HOUSING

(71) Applicant: KUANG-CHI INSTITUTE OF ADVANCED TECHNOLOGY, Shenzhen (CN)

(72) Inventors: Ruopeng Liu, Shenzhen (CN); Shengwei Kong, Shenzhen (CN); Guochang Liu, Shenzhen (CN)

(73) Assignee: KUANG-CHI INSTITUTE OF ADVANCED TECHNOLOGY, Shenzhen (CN)

( * ) Notice: Subject to any disclaimer, the term of this patent is extended or adjusted under 35 U.S.C. 154(b) by 57 days.

(21) Appl. No.: 16/003,076

(22) Filed: Jun. 7, 2018

(65) Prior Publication Data

US 2018/0294538 A1 Oct. 11, 2018

Related U.S. Application Data

(63) Continuation of application No. PCT/CN2016/109115, filed on Dec. 9, 2016.

(30) Foreign Application Priority Data

Dec. 18, 2015 (CN) ..... 2015 1 0956470

(51) Int. Cl.
*H01P 1/20* (2006.01)
*H01P 1/203* (2006.01)
(Continued)

(52) U.S. Cl.
CPC ..... *H01P 1/20381* (2013.01); *H01P 1/20* (2013.01); *H01P 1/2005* (2013.01); *H01Q 1/42* (2013.01); *H01Q 15/0013* (2013.01)

(58) Field of Classification Search
CPC ..... H01P 1/20381; H01P 1/20; H01P 1/2005; H03H 2001/0085
(Continued)

(56) References Cited

U.S. PATENT DOCUMENTS 6,816,032 B1 * 11/2004 Gaynor ..... H01P 1/2039 333/126

FOREIGN PATENT DOCUMENTS

CN 204577544 U * 8/2015
CN 204596926 U 8/2015
(Continued)

OTHER PUBLICATIONS

CN204885436, English translation (Year: 2015).*
European Search Report for PCT/CN2016/09115 (Year: 2019).*

*Primary Examiner* — Rakesh B Patel
(74) *Attorney, Agent, or Firm* — Armstrong Teasdale LLP

(57) ABSTRACT

The present invention discloses a band-pass filtering structure and an antenna housing. The band-pass filtering structure includes a functional layer structure, where the functional layer structure includes two or more first dielectric layers and a second dielectric layer that is disposed between two first dielectric layers, a plurality of first conductive geometric structures displayed in a periodical arrangement are disposed on the first dielectric layer, a plurality of second conductive geometric structures displayed in a periodical arrangement are disposed on the second dielectric layer, the first conductive geometric structure includes two crossly-disposed conductive strips, and the second conductive geometric structure is a closed conductive geometric structure. The present invention resolves a technical problem that filtering performance of an existing band-pass filter is poor due to unreasonable structural design.

15 Claims, 5 Drawing Sheets

(51) Int. Cl.
*H01Q 15/00* (2006.01)
*H01Q 1/42* (2006.01)

(58) Field of Classification Search
USPC ..... 333/175, 185
See application file for complete search history.

(56) References Cited

FOREIGN PATENT DOCUMENTS

| | | | | |
|---|---|---|---|---|
| CN | 104934705 | A | | 9/2015 |
| CN | 104934718 | A | | 9/2015 |
| CN | 204885375 | U | * | 12/2015 |
| CN | 204885436 | U | | 12/2015 |
| CN | 204885449 | U | * | 12/2015 |
| CN | 205264837 | U | | 5/2016 |

* cited by examiner

BAND-PASS FILTERING STRUCTURE AND ANTENNA HOUSING

CROSS REFERENCE TO RELATED APPLICATIONS

This application is a continuation of PCT/CN2016/109115 filed on Dec. 9, 2016, which claims priority to Chinese patent application No. 201510956470.X filed Dec. 18, 2015, both of which are incorporated herein by reference.

TECHNICAL FIELD

The present invention relates to the antenna field, and specifically, to a band-pass filtering structure and an antenna housing.

BACKGROUND

With the rapid development of wireless communication technologies, the use of a filter is becoming more and more extensive. The filter is used to filter a signal, achieving an effect of signal recognition and noise reduction. A band-pass filter is one kind of filters. The band-pass filter is a device that allows waves of a particular frequency band to pass while shielding other frequency bands.

However, the design of an existing band-pass filter is relatively poor in wave transmission performance for electromagnetic waves, is poor in cut-off performance, and does not have good inhibition.

For a problem in the prior art that wave transmission performance of a band-pass filter is poor, currently, no effective solution is yet proposed.

SUMMARY

Embodiments of the present invention provide a band-pass filtering structure and an antenna housing, at least resolving a technical problem that filtering performance of an existing band-pass filter is poor due to unreasonable structural design.

According to one aspect of an embodiment of the present invention, a band-pass filtering structure is provided, including:

a functional layer structure, where the functional layer structure includes two or more first dielectric layers and a second dielectric layer that is disposed between two first dielectric layers, a plurality of first conductive geometric structures displayed in a periodical arrangement are disposed on the first dielectric layer, a plurality of second conductive geometric structures displayed in a periodical arrangement are disposed on the second dielectric layer, the first conductive geometric structure includes two crossly-disposed conductive strips, and the second conductive geometric structure is a closed conductive geometric structure.

Further, the two conductive strips are perpendicular to each other.

Further, the two conductive strips are, respectively, a first conductive strip and a second conductive strip, the first conductive strip is disposed symmetrically with respect to the second conductive strip; and/or, the second conductive strip is disposed symmetrically with respect to the first conductive strip.

Further, one end or both ends of at least one of the conductive strips are disposed with an end conductive geometric structure.

Further, the end conductive geometric structure is circular, elliptical, or polygonal.

Further, the end conductive geometric structure is quadrilateral.

Further, the first conductive strip and/or the second conductive strip has a length of 5.2 millimeters to 7.8 millimeters and a thickness of 0.014 millimeters to 0.022 millimeters.

Further, the closed conductive geometric structure is circular-ring-shaped, circular, elliptical-ring-shaped, elliptical, polygonal-ring-shaped, or polygonal.

Further, the closed conductive geometric structure has an outer diameter of 1.2 millimeters to 1.8 millimeters and an inner diameter of 1 millimeters to 1.5 millimeters.

Further, the band-pass filtering structure further includes a cellular substrate, and the cellular substrate is disposed between two adjacent first dielectric layers.

According to another aspect of an embodiment of the present invention, an antenna housing is further provided, including the foregoing band-pass filtering structure.

In the embodiment of the present invention, a band-pass filtering structure is provided, including a functional layer structure, where the functional layer structure includes two or more first dielectric layers and a second dielectric layer that is disposed between two first dielectric layers, a plurality of first conductive geometric structures displayed in a periodical arrangement are disposed on the first dielectric layer, a plurality of second conductive geometric structures displayed in a periodical arrangement are disposed on the second dielectric layer, the first conductive geometric structure includes two crossly-disposed conductive strips, and the second conductive geometric structure is a closed conductive geometric structure. By means of the functional layer structure, the first conductive geometric structures and the second conductive geometric structures can modulate electromagnetic waves. A propagation direction of the electromagnetic waves can be deflected or waves of an entire frequency band are transmitted or even reflected, so as to maintain good wave transmission performance and relatively small loss while maintaining rapid attenuation, and resolving a technical problem that filtering performance of an existing band-pass filter is poor due to unreasonable structural design.

BRIEF DESCRIPTION OF DRAWINGS

The accompanying drawings described herein are intended for better understanding of the present invention, and constitute a part of this application. Exemplary embodiments and descriptions thereof in the present invention are intended to interpret the present invention and do not constitute any improper limitation on the present invention. In the accompanying drawings.

DESCRIPTION OF EMBODIMENTS

To make a person in the art understand the solutions in the present invention better, the following clearly and completely describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention. It should be noted that in the specification, claims, and foregoing accompanying drawings of the present invention, the terms "first", "second", and so on are intended to distinguish between similar objects but do not necessarily indicate a specific order or a specific sequence. It should be understood that the data termed in such a way are interchangeable in proper circumstances so that the embodiments of the present invention described herein can be implemented in an order except the order illustrated or described herein. In addition, the terms "include", "contain", and any other variants thereof are intended to cover a non-exclusive inclusion. For example, a process, a method, a system, a product, or a device that includes a series of steps or units is not limited to the clearly listed steps or units, but optionally further includes a step or unit that is not clearly listed, or another inherent step or unit of the process, the method, the product, or the device.

Figure 1:
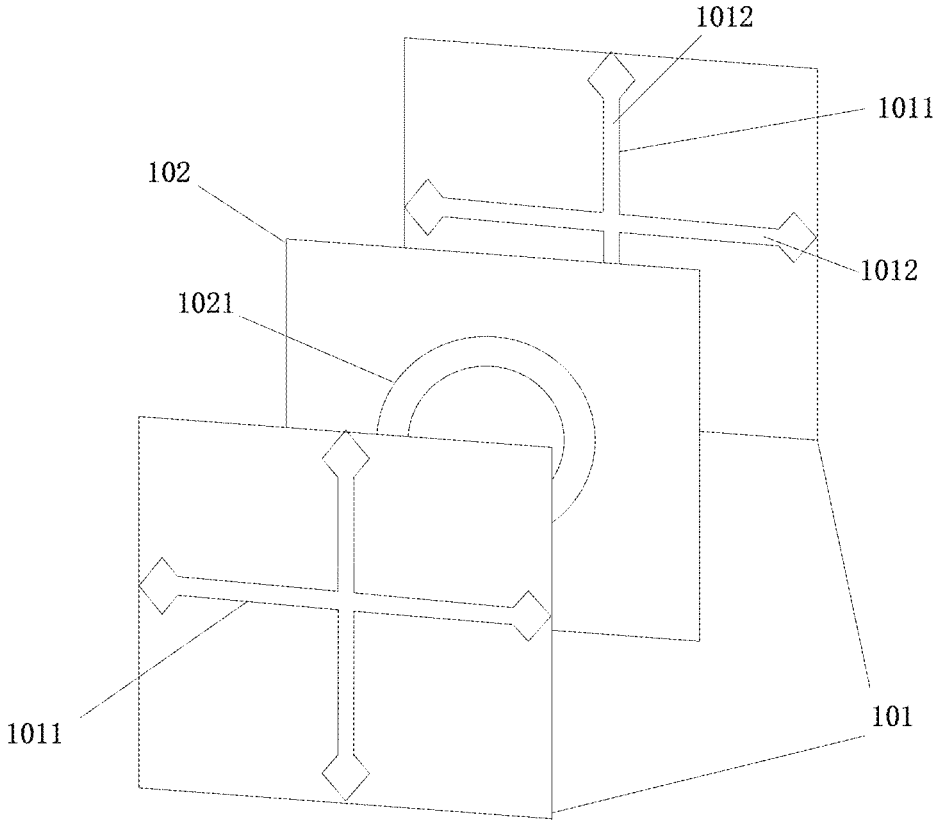
FIG. 1 is a schematic structural diagram of a band-pass filtering structure according to an embodiment of the present invention.
Figure 6:
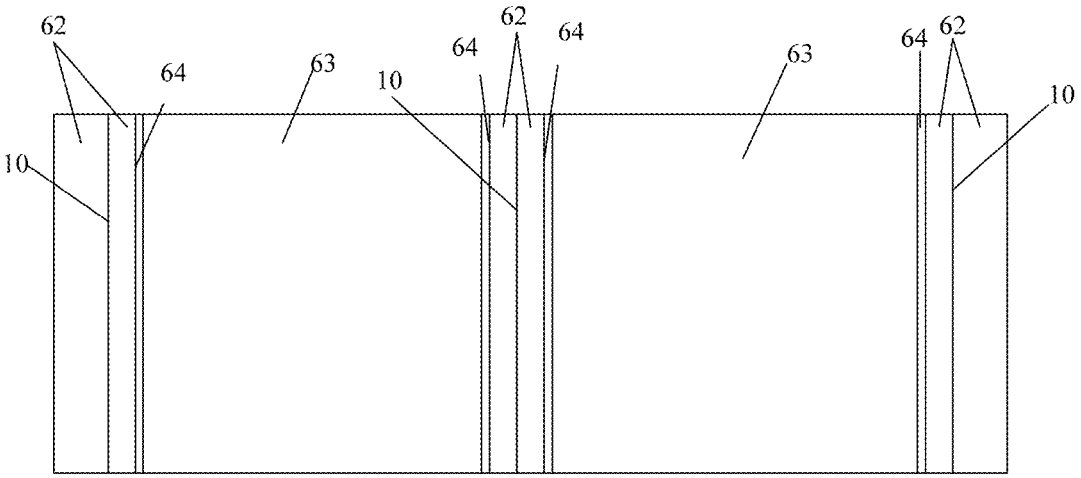
FIG. 6 is a schematic sectional view of an optional band-pass filtering structure according to an embodiment of the present invention.

FIG. 1 shows a band-pass filtering structure according to an embodiment of the present invention. As shown in FIG. 1, the band-pass filtering structure includes:

a functional layer structure 10 (as shown in FIG. 6), where the functional layer structure 10 includes two or more first dielectric layers 101 and a second dielectric layer 102 that is disposed between two first dielectric layers 101, a plurality of first conductive geometric structures 1011 displayed in a periodical arrangement are disposed on the first dielectric layers 101, a plurality of second conductive geometric structures 1021 displayed in a periodical arrangement are disposed on the second dielectric layer 102, the first conductive geometric structure 1011 includes two crossly-disposed conductive strips 1012, and the second conductive geometric structure 1021 is a closed conductive geometric structure. The first conductive geometric structure 1011 and the second conductive geometric structure 1021 adopt a manner of being hollow in the middle, and have greater filtering capacitance when compared with a solid-core conductive geometric structure.

By means of the band-pass filtering structure provided by the embodiment of the present invention, the functional layer structure 10, the first conductive geometric structures 1011, and the second conductive geometric structures 1021 can modulate electromagnetic waves. A propagation direction of the electromagnetic waves can be deflected or waves of an entire frequency band are transmitted or even reflected, so as to maintain good wave transmission performance and relatively small loss while maintaining rapid attenuation, and resolving a technical problem that filtering performance of an existing band-pass filter is poor due to unreasonable structural design.

Optionally, the two conductive strips 1012 are perpendicular to each other. The two conductive strips 1012 are, respectively, a first conductive strip and a second conductive strip, the first conductive strip is disposed symmetrically with respect to the second conductive strip; and/or, the second conductive strip is disposed symmetrically with respect to the first conductive strip, thereby more accurately modulating electromagnetic waves.

Optionally, one end or both ends of at least one of the conductive strips 1012 are disposed with an end conductive geometric structure, thereby increasing a cut-off frequency and reducing a resonance frequency.

Optionally, the end conductive geometric structure is circular, elliptical, or polygonal.

Optionally, the end conductive geometric structure is quadrilateral.

Figure 2:
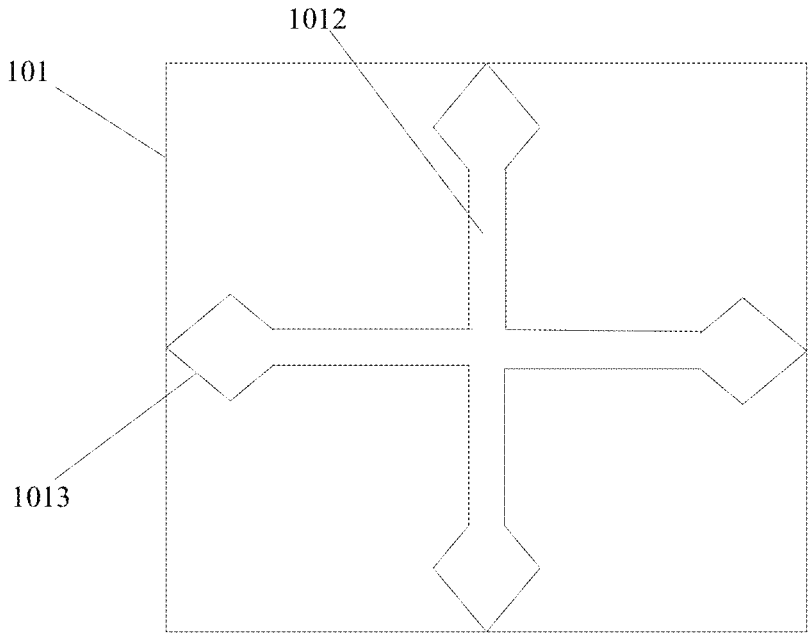
FIG. 2 is a schematic structural diagram of a first dielectric layer of an optional band-pass filtering structure according to an embodiment of the present invention.
Figure 3:
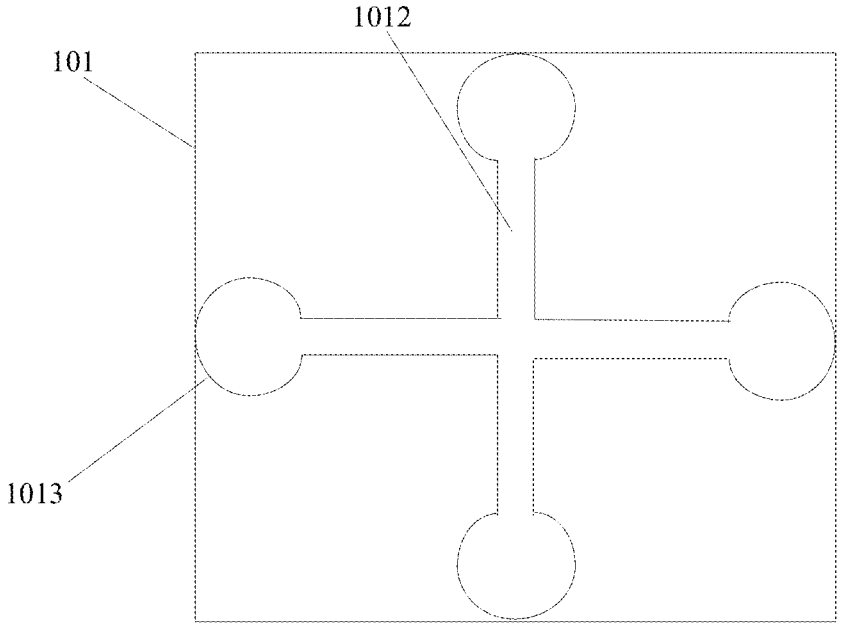
FIG. 3 is a schematic structural diagram of a first dielectric layer of another optional band-pass filtering structure according to an embodiment of the present invention.

As shown in FIG. 2, the two conductive strips 1012 shown in FIG. 2 are perpendicular to each other, one end or both ends of at least one of the conductive strips 1012 are disposed with an end conductive geometric structure 1013, and the end conductive geometric structure 1013 is quadrilateral. Certainly, the embodiment of the present invention is not limited thereto. As shown in FIG. 3, the end conductive geometric structure 1013 can also be circular.

Optionally, the first conductive strip and/or the second conductive strip has a length of 5.2 millimeters to 7.8 millimeters and a thickness of 0.014 millimeters to 0.022 millimeters. Preferably, the first conductive strip and/or the second conductive strip has a length of 6.5 millimeters and a thickness of 0.018 millimeters.

Optionally, the closed conductive geometric structure is circular-ring-shaped, circular, elliptical-ring-shaped, elliptical, polygonal-ring-shaped, or polygonal.

Figure 4:
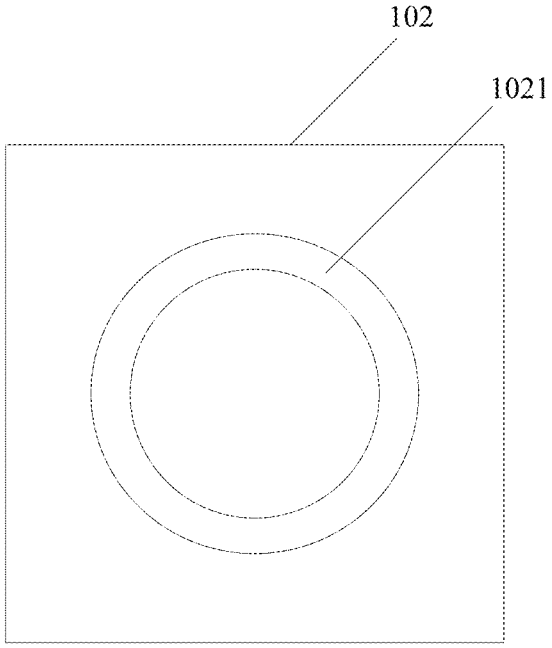
FIG. 4 is a schematic structural diagram of a second dielectric layer of an optional band-pass filtering structure according to an embodiment of the present invention.
Figure 5:
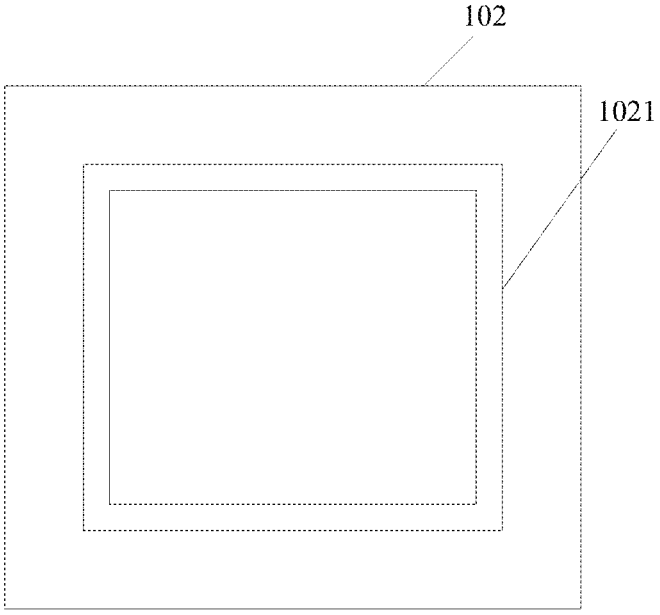
FIG. 5 is a schematic structural diagram of a second dielectric layer of another optional band-pass filtering structure according to an embodiment of the present invention.
Figure 8:
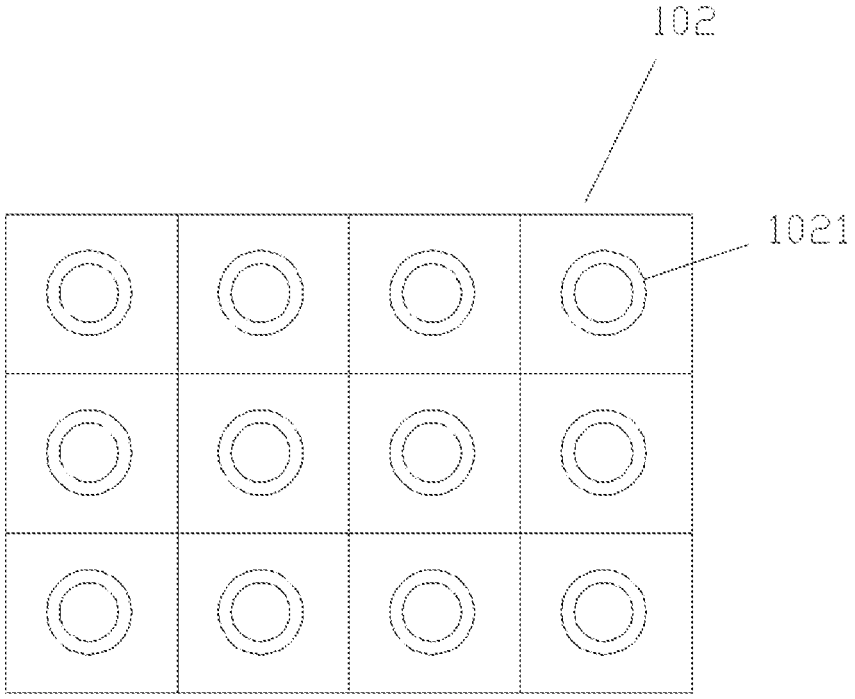
FIG. 8 is a schematic structural diagram of a second dielectric layer of yet another optional band-pass filtering structure according to an embodiment of the present invention.

As shown in FIG. 4, the second conductive geo-metric structure 1021 disposed on the second dielectric layer 102 is a closed conductive geometric structure. Optionally, the closed conductive geometric structure has an outer diameter of 1.2 millimeters to 1.8 millimeters, with 1.5 millimeters preferred, and an inner diameter of 1 millimeters to 1.5 millimeters, with 1.25 millimeters preferred. It should be noted that the closed conductive geometric structure can also be a square structure as shown in FIG. 5, and certainly, can also be another polygonal structure. As shown in FIG. 8, the second dielectric layer 102 includes a plurality of second conductive geometric structures 1021.

Optionally, at least a part or all parts of the first conductive geometric structure 1011 and the second conductive geometric structure 1021 are disposed correspondingly.

Optionally, a quantity of layers in the functional layer structure 10 is an odd number. As shown in FIG. 1, for example, the functional layer structure 10 includes two first dielectric layers 101 and one second dielectric layer 102, where the second dielectric layer 102 is disposed between the two adjacent first dielectric layers 101. In this way, a band-pass filter that includes the functional layer structure 10 can realize the modulation of electromagnetic waves, thereby increasing a cut-off frequency and reducing a resonance frequency and further improving the transmittance of the electromagnetic waves.

In a possible implementation manner of the present invention, the band-pass filter includes prepreg substrates that are disposed in layers, a cellular substrate, and a film substrate, where the functional layer structure 10 is disposed between two adjacent layers of prepreg substrates, a layer of the cellular substrate is disposed between two adjacent prepreg substrates, the film substrate is disposed between the prepreg substrate and the cellular substrate, and the prepreg substrate and the cellular substrate are bonded together by using a film on the film substrate.

With reference to FIG. 6, the following gives an exemplary description about connection relationships between the foregoing prepreg substrates 62 that are disposed in layers, the cellular substrate 63, and the film substrate 64. It can be learned from a schematic sectional view of a band-pass filtering structure shown in FIG. 6 that the functional layer structure 10 is disposed between the prepreg substrates 62 that are disposed in layers, two adjacent prepreg substrates 62 are separated by using the cellular substrate 63, and the prepreg substrate 62 and the cellular substrate 63 are connected by using the film substrate 64. In this way, the foregoing band-pass filter can achieve good wave transmission performance and relatively small insertion loss.

Figure 7:
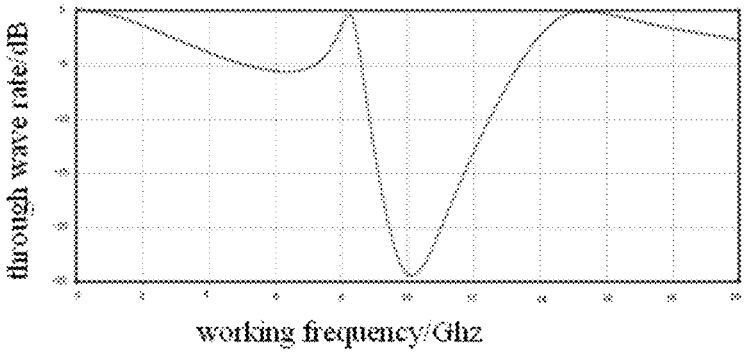
FIG. 7 is a schematic diagram of a simulation result of an optional band-pass filtering structure according to an embodiment of the present invention.

FIG. 7 provides a schematic diagram showing an effect of using the foregoing band-pass filter to perform filtering simulation. It can be seen from FIG. 7 that the band-pass filter has good wave transmission performance on an operating frequency of 8.3 GHz, rapid attenuation occurs after that, reaching attenuation of 20 dB to 25 dB within 8.3 GHz to 9.3 GHz, and total insertion loss is less than 1 dB. From this, it can be see that a band-pass filter provided by the present invention achieves good wave transmission performance and relatively small loss.

An embodiment of the present invention further provides an antenna housing, including the band-pass filtering structure described in the foregoing embodiment. The antenna housing has good cut-off performance.

The foregoing descriptions are merely exemplary implementation manners of the present invention. It should be noted that a person of ordinary skill in the art may make several improvements and polishing without departing from the principle of the present invention and the improvements and polishing shall fall within the protection scope of the present invention.

What is claimed is:

1. A band-pass filtering structure, comprising a functional layer structure, wherein the functional layer structure comprises two or more first dielectric layers and a second dielectric layer that is disposed between two of the two or more first dielectric layers, a plurality of first conductive geometric structures displayed in a periodical arrangement are disposed on each of the two or more first dielectric layers, a plurality of second conductive geometric structures displayed in a periodical arrangement are disposed on the second dielectric layer, each of the plurality of first conductive geometric structures comprises two conductive strips disposed crossly, and each of the plurality of second conductive geometric structures is a closed conductive geometric structure; the closed conductive geometric structure has an outer diameter of 1.2 millimeters to 1.8 millimeters and an inner diameter of 1 millimeters to 1.5 millimeters.

2. The band-pass filtering structure according to claim 1, wherein the two conductive strips are perpendicular to each other.

3. The band-pass filtering structure according to claim 2, wherein the two conductive strips are, respectively, a first conductive strip and a second conductive strip, the first conductive strip is disposed symmetrically with respect to the second conductive strip; and/or, the second conductive strip is disposed symmetrically with respect to the first conductive strip.

4. The band-pass filtering structure according to claim 3, wherein one end or two ends of at least one of the two conductive strips are disposed with an end conductive geometric structure.

5. The band-pass filtering structure according to claim 4, wherein a shape of the end conductive geometric structure is circular, elliptical, or polygonal.

6. The band-pass filtering structure according to claim 5, wherein a shape of the end conductive geometric structure is quadrilateral.

7. The band-pass filtering structure according to claim 6, wherein the first conductive strip and/or the second conductive strip has a length of 5.2 millimeters to 7.8 millimeters and a thickness of 0.014 millimeters to 0.022 millimeters.

8. The band-pass filtering structure according to claim 1, wherein a shape of the closed conductive geometric structure is circular-ring-shaped, circular, elliptical-ring-shaped, elliptical, polygonal-ring-shaped, or polygonal.

9. The band-pass filtering structure according to claim 2, wherein a shape of the closed conductive geometric structure is circular-ring-shaped, circular, elliptical-ring-shaped, elliptical, polygonal-ring-shaped, or polygonal.

10. The band-pass filtering structure according to claim 3, wherein a shape of the closed conductive geometric structure is circular-ring-shaped, circular, elliptical-ring-shaped, elliptical, polygonal-ring-shaped, or polygonal.

11. The band-pass filtering structure according to claim 4, wherein a shape of the closed conductive geometric structure is circular-ring-shaped, circular, elliptical-ring-shaped, elliptical, polygonal-ring-shaped, or polygonal.

12. The band-pass filtering structure according to claim 5, wherein a shape of the closed conductive geometric structure is circular-ring-shaped, circular, elliptical-ring-shaped, elliptical, polygonal-ring-shaped, or polygonal.

13. The band-pass filtering structure according to claim 6, wherein a shape of the closed conductive geometric structure is circular-ring-shaped, circular, elliptical-ring-shaped, elliptical, polygonal-ring-shaped, or polygonal.

14. The band-pass filtering structure according to claim 1, wherein the band-pass filtering structure further comprises a cellular substrate, and the cellular substrate is disposed between two adjacent first dielectric layers in the two or more first dielectric layers.

15. An antenna housing, comprising the band-pass filtering structure according to claim 1.

* * * * *